US006428161B1

(12) United States Patent
Wotton et al.

(10) Patent No.: US 6,428,161 B1
(45) Date of Patent: Aug. 6, 2002

(54) DRYING APPARATUS

(75) Inventors: Geoff M. Wotton, Battleground, WA (US); Steven B Elgee, Portland, OR (US); David E Smith, Vancouver, WA (US); Harold D. Kimrey, Jr., Knoxville, TN (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/846,147

(22) Filed: Apr. 30, 2001

(51) Int. Cl.[7] ..... B41J 2/01; H05B 1/00
(52) U.S. Cl. ..... 347/102; 347/101; 219/216
(58) Field of Search ..... 347/101, 102, 347/105; 219/693, 216

(56) References Cited

U.S. PATENT DOCUMENTS

| | | | | |
|---|---|---|---|---|
| 4,327,174 A | | 4/1982 | von Meer | 430/530 |
| 4,816,912 A | * | 3/1989 | Suzuki et al. | 346/108 |
| 5,220,346 A | * | 6/1993 | Carreira et al. | 347/102 |
| 5,264,869 A | * | 11/1993 | Appel et al. | 346/108 |
| 5,500,668 A | | 3/1996 | Malhotra et al. | 347/105 |
| 5,563,644 A | | 10/1996 | Isganitis et al. | 347/102 |
| 5,631,685 A | * | 5/1997 | Gooray et al. | 347/102 |
| 5,693,129 A | | 12/1997 | Lin | 106/31.43 |
| 5,814,138 A | | 9/1998 | Fague | 106/31.43 |
| 5,853,469 A | | 12/1998 | Colt et al. | 106/31.49 |
| 5,997,623 A | | 12/1999 | Lin | 106/31.58 |
| 6,048,059 A | | 4/2000 | Wafler | 347/102 |
| 6,090,749 A | | 7/2000 | Kowalski | 347/105 |

OTHER PUBLICATIONS

Hewlett–Packard Company patent application, filed on Jun. 30, 2000, Ser. No.: 09/608,597, "Printer Including Microwave Dryer".

Metaxas, A.C. and R.J. Meredith, 1983, pp 42–43 in "Industrial Microwave Heating," Peter Peregrinus Ltd., London, United Kingdom.

Schiffman, Robert F., May 8–10, 2000, pp 36–39 in materials from the seminar "Fundamentals of Dielectic Heating," sponsored by The Center for Professional Advancement and presented by Robert F. Schiffman Associates Inc., 149 West 88th Street, New York, NY 10024.

Gerling, John E., 1973, "Applicators and Their Design," Transactions IMPI 1, Paper No. 10, pp 144–158.

* cited by examiner

*Primary Examiner*—John Barlow
*Assistant Examiner*—An H. Do
(74) *Attorney, Agent, or Firm*—Gregg W. Wisdom

(57) ABSTRACT

An embodiment of a drying apparatus for drying ink deposited onto media includes an electromagnetic energy source to generate electromagnetic energy. The embodiment of the drying apparatus also includes a rectangular waveguide coupled to the electromagnetic energy source. The rectangular waveguide includes slots in the axial direction of the rectangular waveguide on opposite sidewalls corresponding to the largest sides forming a cross section of the rectangular waveguide. The electromagnetic energy source is configured to establish a $TE_{01}$ mode within the rectangular waveguide, resulting in an electric field substantially perpendicular to the longitudinal axes of fibers within the media and thereby reducing power dissipated within the media while providing sufficient power for drying the ink during a drying operation.

30 Claims, 9 Drawing Sheets

DRYING APPARATUS

FIELD OF THE INVENTION

This invention relates to heating using electromagnetic energy. More particularly, this invention relates to the drying of a fluid using electromagnetic energy.

BACKGROUND OF THE INVENTION

The formation of images on media, such as paper, in inkjet imaging devices can lead to wrinkling of the media resulting from the absorption of fluid from ink deposited upon the paper. A need exists for a method and apparatus to dry the ink that will reduce the degree of wrinkling of the media resulting from the placement of ink onto the media, improve the efficiency of the drying operation, and permit handling of the media within the imaging device without disturbing the image formed on the media after the placement of the ink onto the media.

SUMMARY OF THE INVENTION

Accordingly, a drying apparatus for drying a fluid residing on media, includes a waveguide having an aperture configured to allow the media to move through the aperture. In addition, the drying apparatus includes an electromagnetic energy source configured to establish an electric field within the waveguide, with an angle formed between a direction of the electric field and a longitudinal axes of fibers within the media greater than ten degrees and less than or equal to ninety degrees.

A method for drying a fluid residing on media, includes generating an electric field. The method further includesexposing the media and the fluid to the electric field, with an angle between the electric field and a longitudinal axes of fibers included within the media greater than ten degrees and less than or equal to ninety degrees.

An imaging device for forming an image on media corresponding to image data, includes a controller configured to generate signals from the image data and a print head arranged to receive the signals and configured to eject ink onto the media according to the signals. The imaging device also includes a drying apparatus including a waveguide having an aperture configured to allow the media to move through the aperture, and an electromagnetic energy source configured to establish an electric field within the waveguide. An angle formed between a direction of the electric field and a longitudinal axes of fibers within the media ranges between greater than forty-five degrees and less than or equal to ninety degrees.

DESCRIPTION OF THE DRAWINGS

A more thorough understanding of embodiments of the drying apparatus may be had from the consideration of the following detailed description taken in conjunction with the accompanying drawings in which:

Shown in FIG. 1 is a simplified schematic diagram of an embodiment of an inkjet imaging device that includes an embodiment of the drying apparatus.

Figure 2:
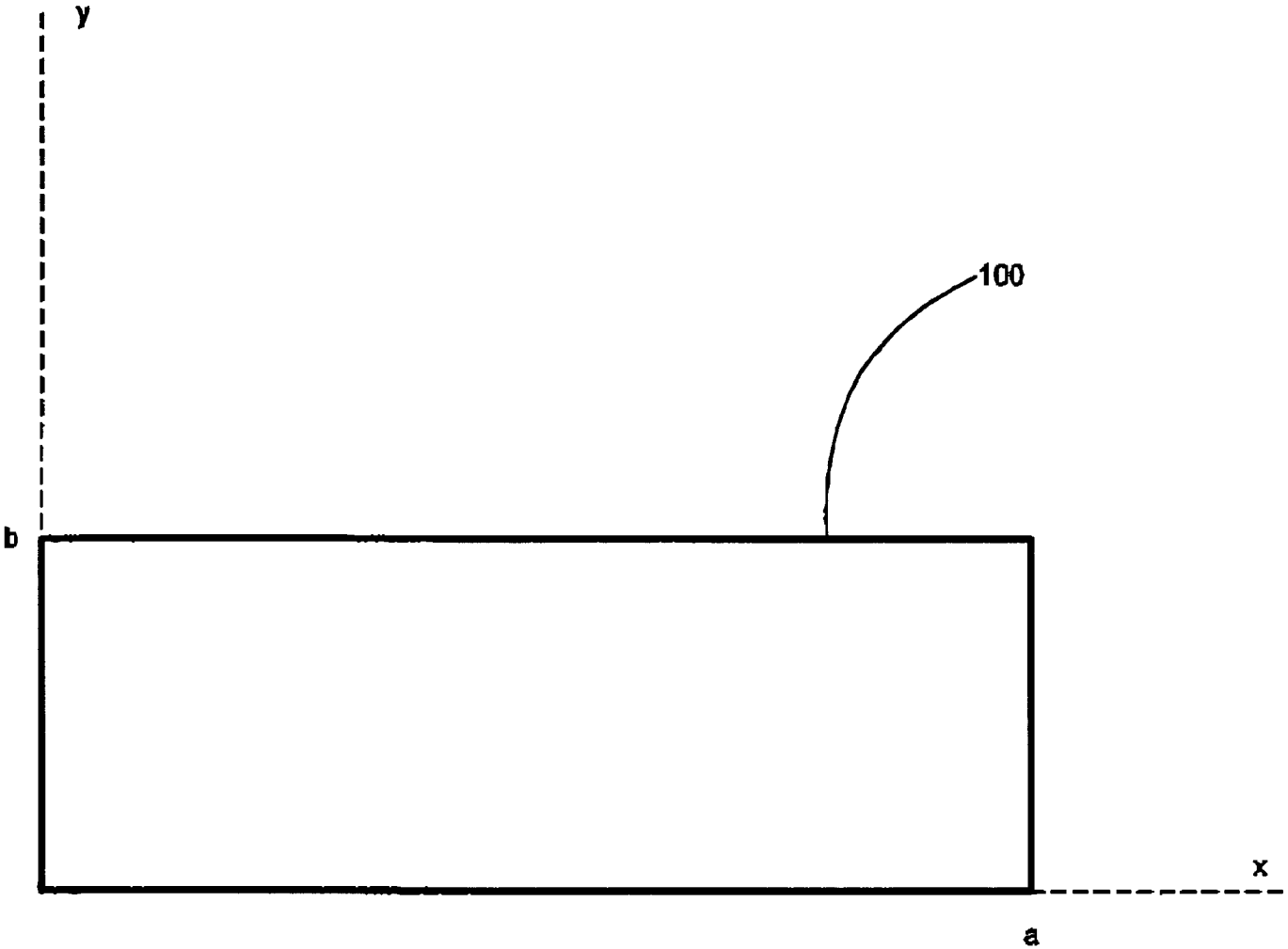

Shown in FIG. 2 is a c ross sectional view of a rectangular waveguide.

Figure 3A:
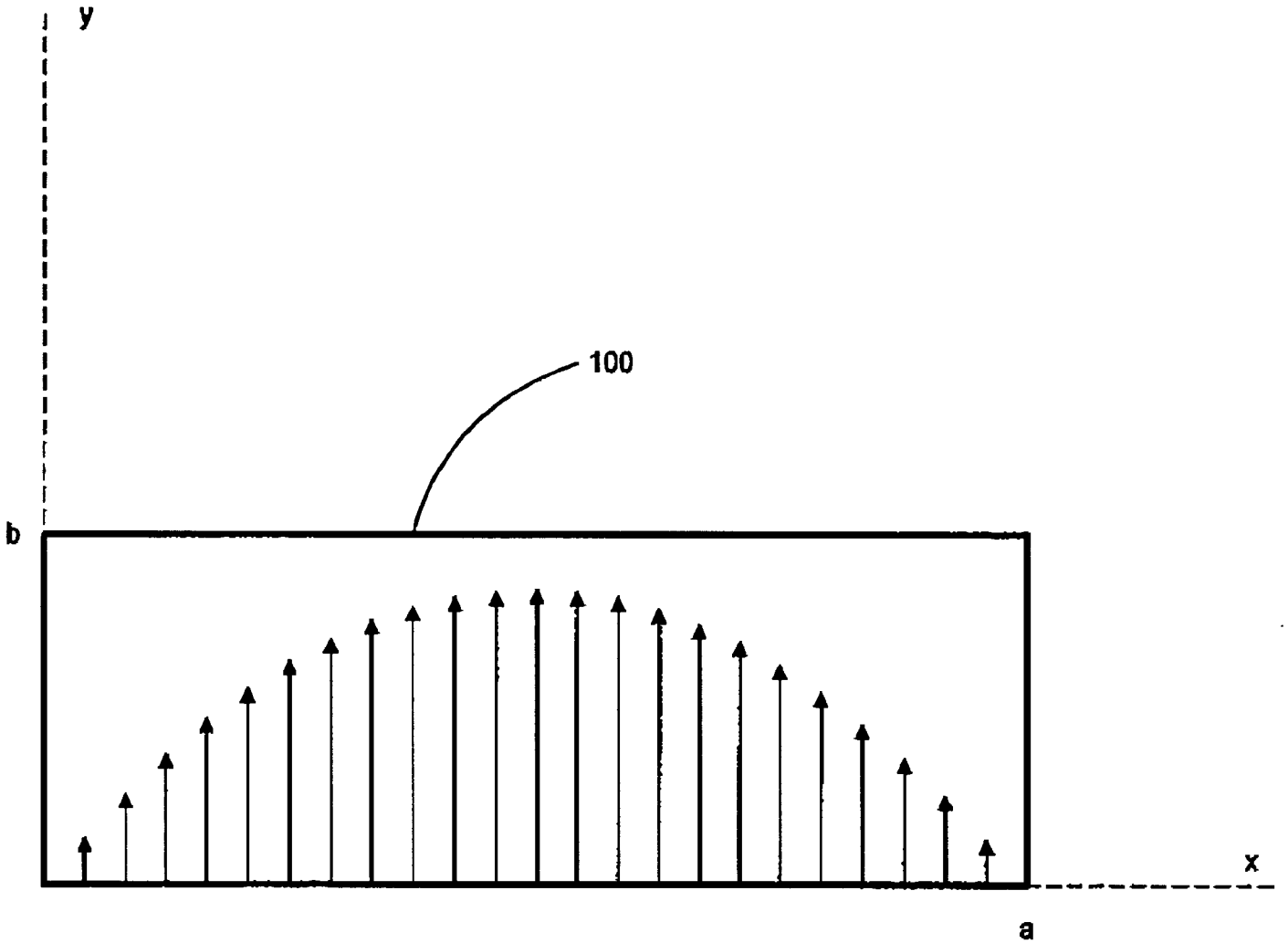
Figure 3B:
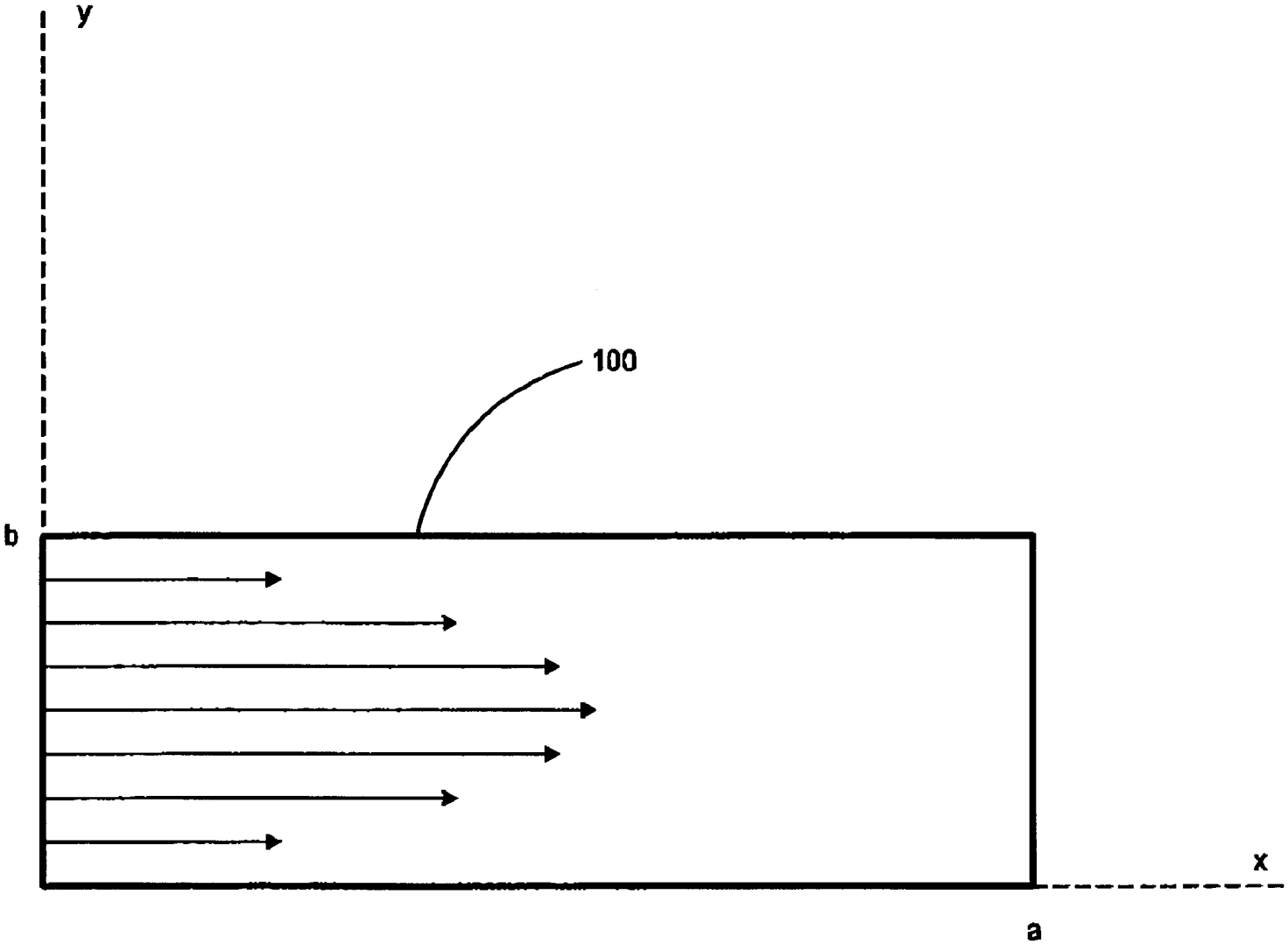

Shown in FIG. 3A and FIG. 3B is a cross sectional view of a rectangular waveguide showing, respectively, the electric field established for the $TE_{01}$ mode and the $TE_{01}$ mode.

Figure 4:
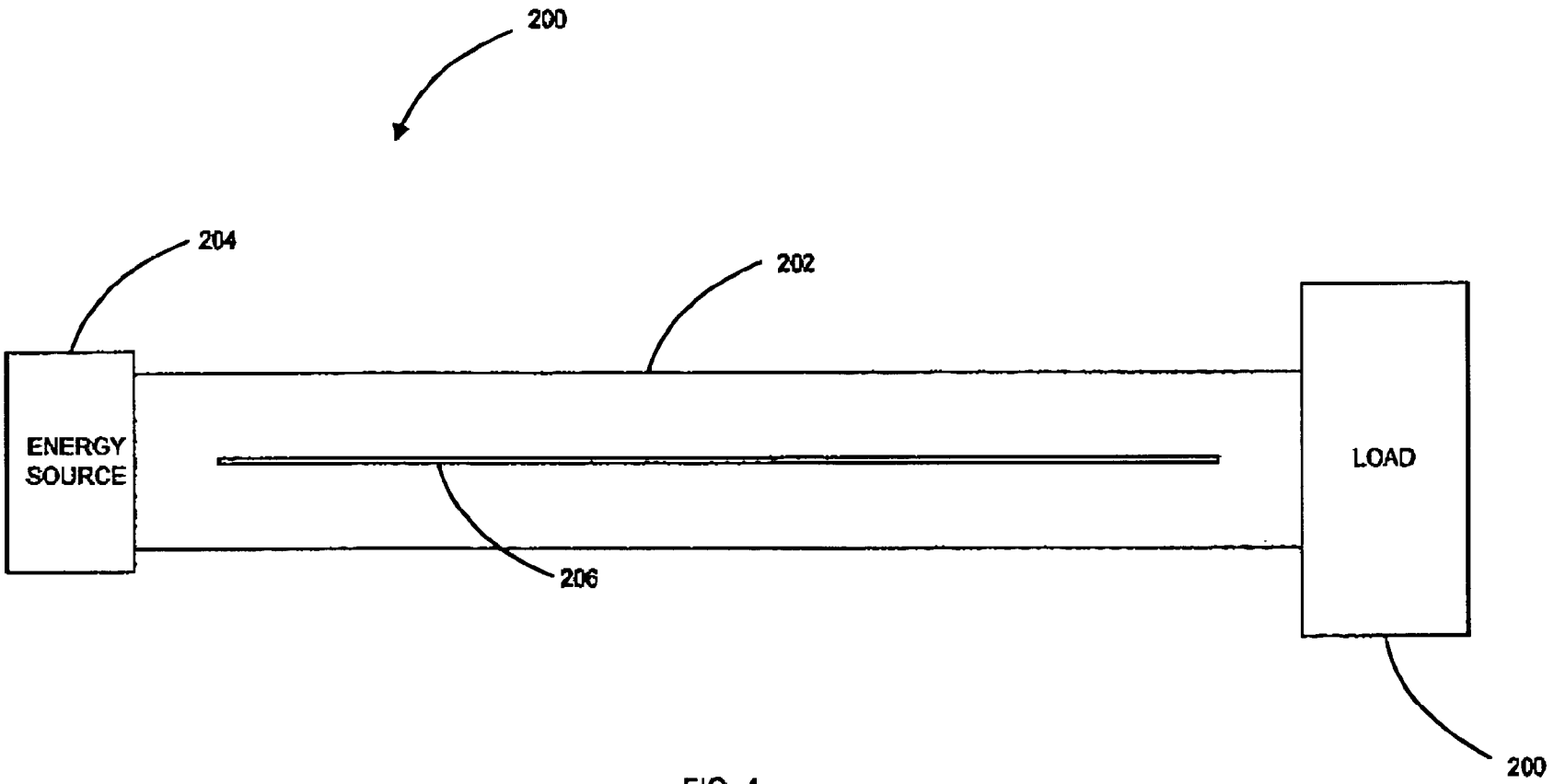

Shown in FIG. 4 is a simplified schematic diagram of an embodiment of the drying apparatus.

Figure 5:
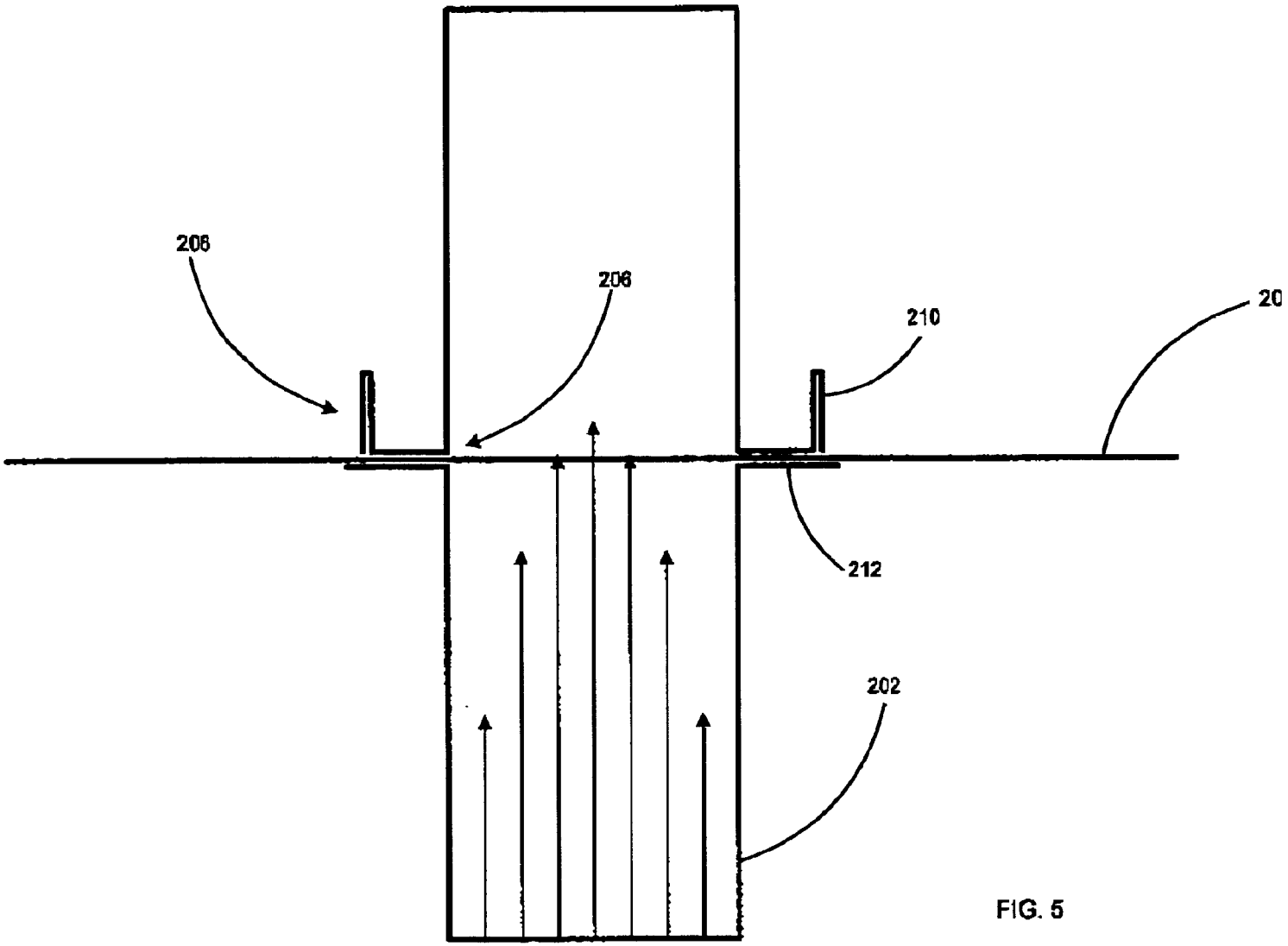

Shown in FIG. 5 is the spatial relationship between an electric field and media in a rectangular waveguide that could be used in an embodiment of the drying apparatus.

Figure 6:
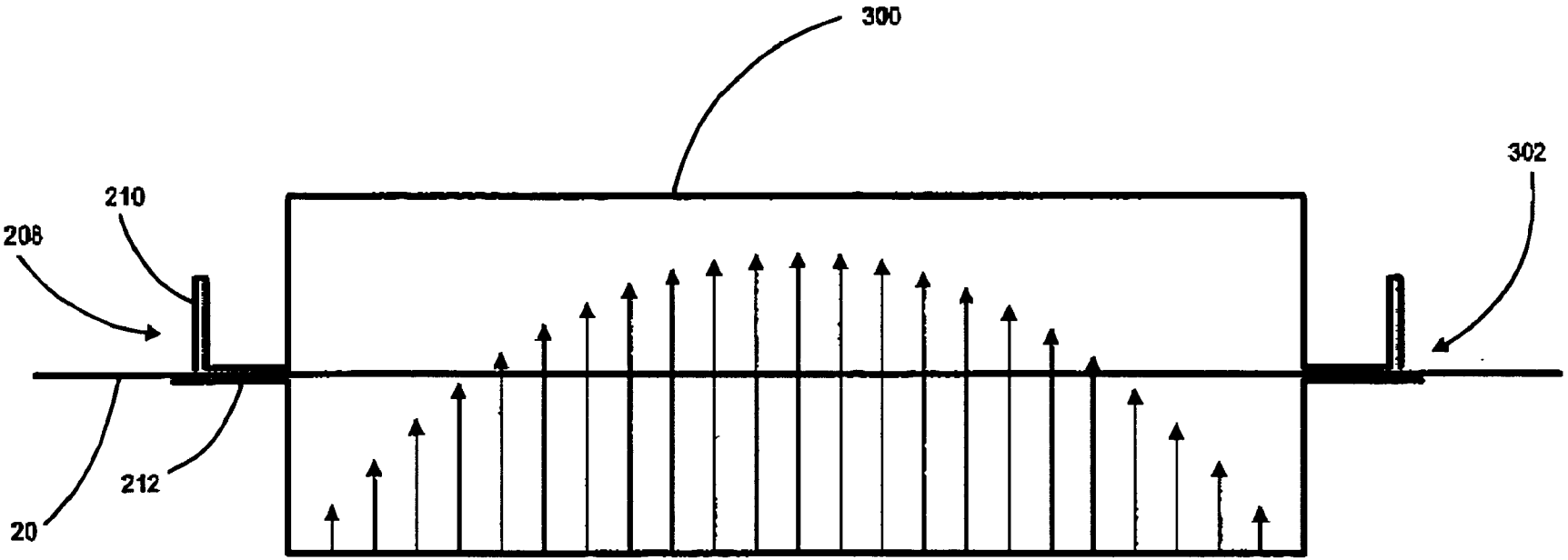

Shown in FIG. 6 is a spatial relationship between an electric field and media in a rectangular waveguide that could be used in an embodiment of the drying apparatus.

Figure 7:
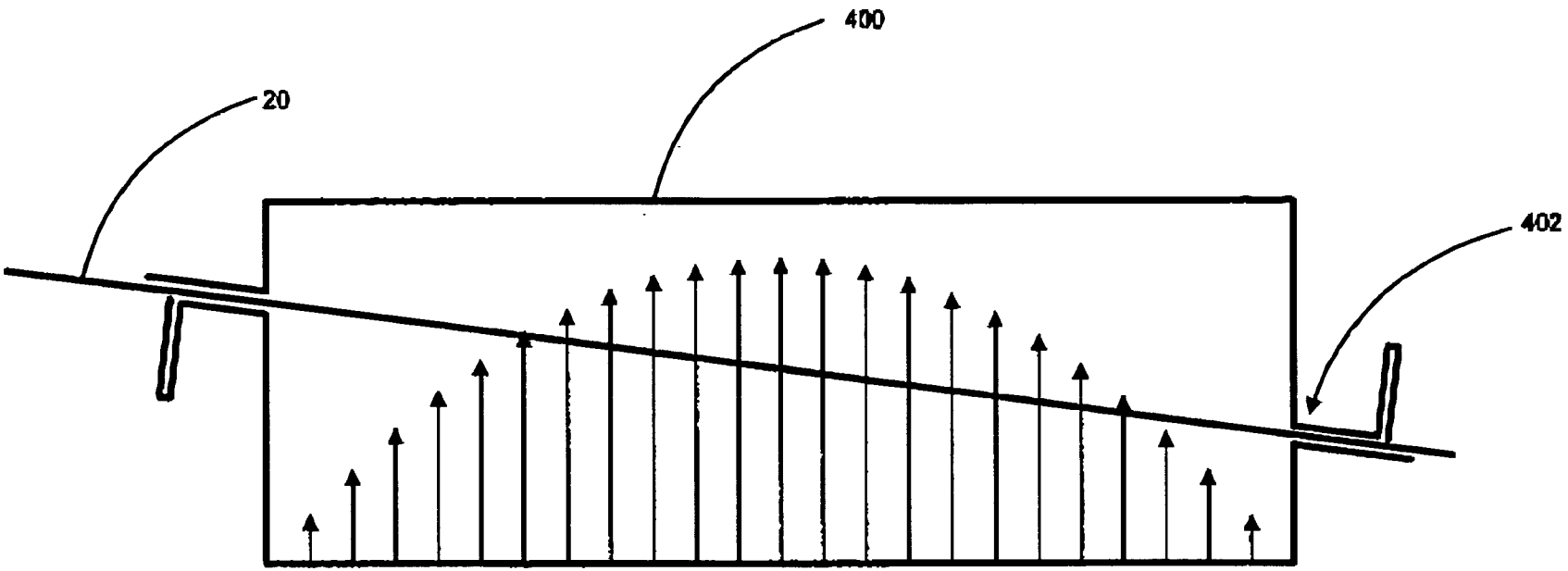

Shown in FIG. 7 is a spatial relationship between an electric field and media in a rectangular waveguide that could be used i n an embodiment of the drying apparatus.

Figure 8:
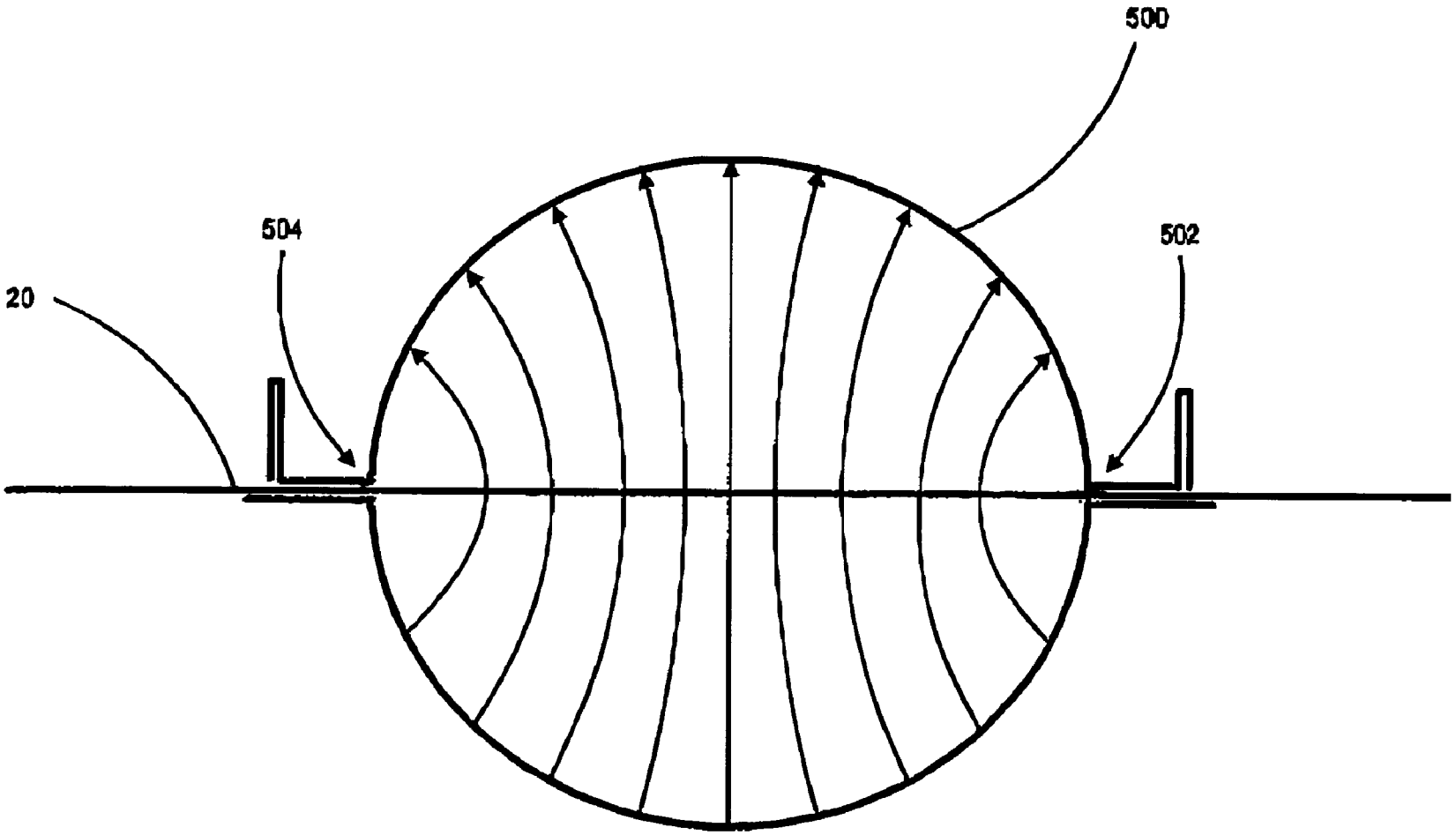

Shown in FIG. 8 is a spatial relationship between an electric field and media in a circular waveguide that could be used in an embodiment of the drying apparatus.

DETAILED DESCRIPTION OF THE DRAWINGS

The drying apparatus is not limited to the disclosed embodiments. Although an embodiment of the drying apparatus will be disclosed in the context of an inkjet imaging device, such as an inkjet printer, it should be recognized that embodiments of the drying apparatus could be used in a variety of applications in which it is desired to selectively dry a fluid while reducing heating of the material upon which the fluid is placed.

Figure 1:
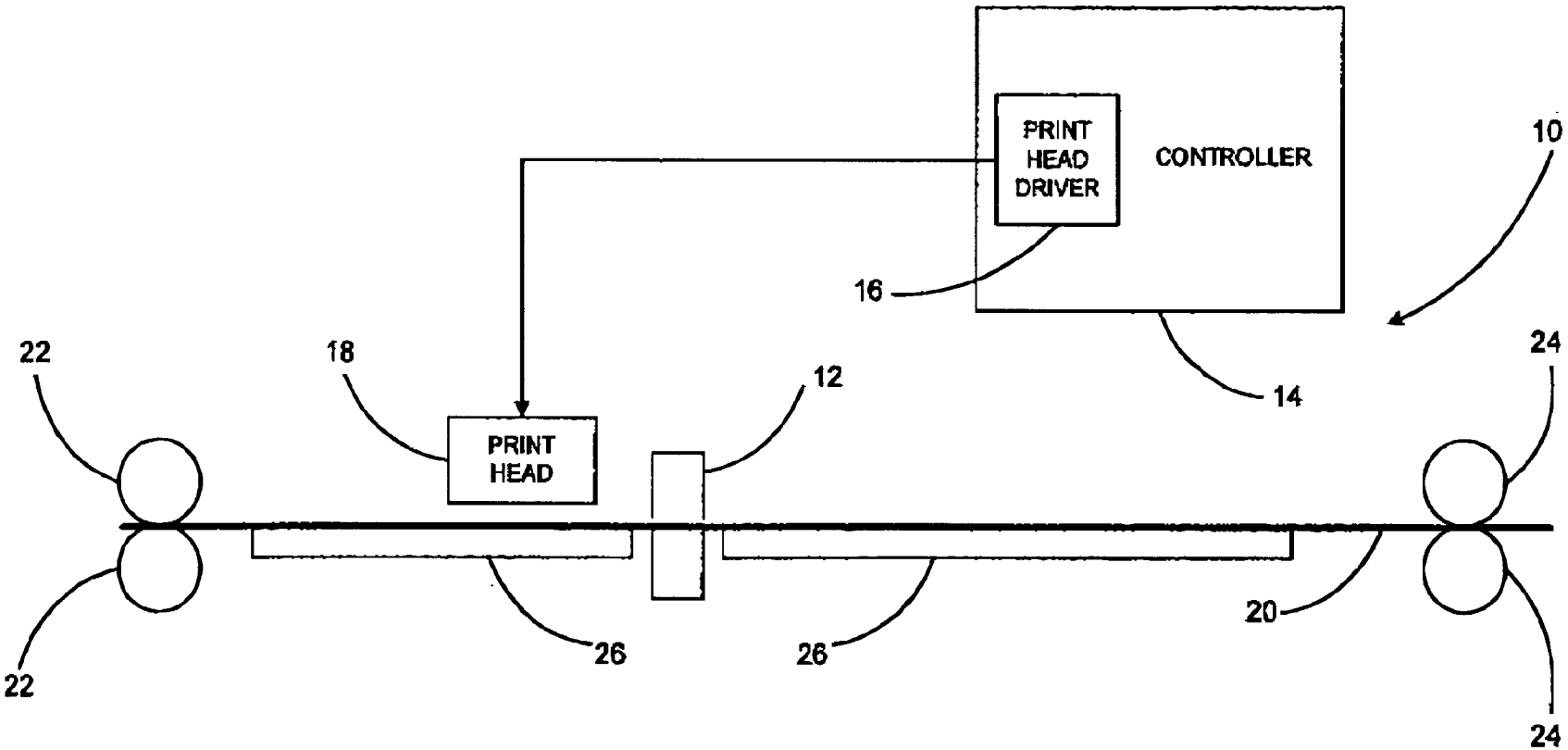

Shown in FIG. 1 is a simplified schematic diagram of an embodiment of an inkjet imaging device, inkjet printer 10, including a simplified representation of an embodiment of the drying apparatus, radiation heater 12. Controller 14 receives image data corresponding to an image and generates print data used by print head driver 16 included within controller 14. It should be recognized that, alternatively, inkjet printer 10 could be implemented with printhead driver 16 located externally to controller 14. Typically, the image data is supplied by a computer. Print head driver 16 generates drive signals that cause print head 18 to eject ink onto media 20 in a way that forms an image corresponding to the image data. The ink may include compounds added to increase its dielectric loss. Print head 18 includes an array of nozzles from which ink droplets are ejected. Print head 18 includes reservoirs for storing the different colors of ink (such as cyan, magenta, yellow, and black) used to form the images on media 20. Input drive rollers 22 and output driver rollers 24, move media 20 between media support 26 and print head 18. It should be recognized that although embodiments of the drying apparatus are disclosed in the context of an inkjet imaging device for which the printhead is fixed, embodiments of the drying apparatus could be used within inkjet imaging devices that use movable printheads.

After passing beneath print head 18, media 20 passes through radiation heater 12 during which water is removed from the ink by exposure to the electromagnetic energy generated by radiation heater 12. Radiation heater 12 exposes media 20 to the electromagnetic energy it generates so that the ink absorbs significantly more power than media 20. As a result, water is removed from the ink deposited on media 20 without significant heating of media 20, thereby reducing the amount of shrinking experienced by media 20. In addition, because radiation heater 12 is positioned close to print head 18 and downstream print head 18 in the media path, water is removed from the ink sufficiently rapidly to significantly reduce the amount of water absorbed into media 20, thereby reducing distortion of media 20 that would result from water absorption. However, depending upon the rate at which media 20 is moved, print head 18 maybe positioned farther or more closely to print head 18. Because the ink has been dried, subsequent handling of the media within inkjet printer 10 will not disturb the image formed onto the surface of media 20. This would be particularly advantageous for a duplex imaging operation because the subsequent handling of media 20 within inkjet printer 10 would not disturb the deposited ink that had been dried.

Consider rectangular waveguide 100, as shown in FIG. 2, orientated so that the "b" dimension corresponds to the y axes and the "a" dimension corresponds to the x axes, with a>b. The general expression for the cutoff frequency of rectangular waveguide 100 is provided in equation 1.

$$f_c=(1/(2\pi\sqrt{\mu\in})[(n\pi/a)^2+(m\pi/b)^2]^{1/2} \quad \text{Eq. 1}$$

For the $TE_{10}$ mode, the cutoff frequency is given by equation 2.

$$f_{c10}=1/(2a\sqrt{\mu\in}) \quad \text{Eq. 2}$$

For the $TE_{20}$ mode (the next higher mode that would most likely be excited in a waveguide having a probe positioned to excite the $TE_{10}$ mode), the cutoff frequency is given by equation 3.

$$f_{c20}=1/(a\sqrt{\mu\in}) \quad \text{Eq. 3}$$

Therefore, the cutoff frequency for the $TE_{20}$ mode is at a higher frequency than the cutoff frequency for the $TE_{10}$ mode. Through selection of the dimensions of rectangular waveguide 100 and the selection of the frequency of the electromagnetic energy coupled into it so that the selected frequency is above $f_{c10}$ and below $f_{c20}$, propagation of the $TE_{10}$ mode can be preferentially established over the $TE_{20}$ mode. Similarly, propagation of the $TE_{01}$ mode can be preferentially established over the propagation of the $TE_{02}$ mode through selection of the dimensions of rectangular waveguide 100 and the frequency of the electromagnetic energy coupled into it.

For the $TE_{10}$ mode, the axial electric field component is zero and the transverse electric field component has only a component corresponding to the y axes. The spatial variation of the transverse electric field is given by equation 4.

$$E_y \sim \sin(\pi x/a)\in^{j\beta z} \text{ where } O<=x<=a \quad \text{Eq. 4}$$

As can be seen from equation 4, the magnitude of the transverse electric field at x=O and x=a is zero and varies sinusoidally in the x dimension across rectangular waveguide 100. The spatial variation of the transverse electric field in the z dimension (the axial direction in rectangular waveguide 100) is determined by the propagation constant β. The value of β can, in general, be complex, including an imaginary component and a real component[00ab] The real component of β is dependent upon the mode propagating within rectangular waveguide 100 and the permittivity and permeability of the dielectric (typically air) within rectangular waveguide 100. The real component of β accounts for the shift in the phase of the electric field dependent upon the position along the z axis within rectangular waveguide 100. The imaginary component is dependent upon resistive loss in the walls of rectangular waveguide 100 (usually relatively small) or energy absorption by a load, such as ink and media, placed within rectangular waveguide 100. The imaginary component of β corresponds to the attenuation constant for the magnitude of the electric field along the z axis within rectangular waveguide 100 where the loading occurs.

For the $TE_{01}$ mode, the axial electric field component is zero and the transverse electric field component has only a component corresponding to the x axes. The spatial variation of the transverse electric field is given by equation 5.

$$E_x \sim \sin(\pi y/b)\in^{j\beta z} \text{ where } O<=x<=b \quad \text{Eq.5}$$

As can be seen from equation 5, the magnitude of the transverse electric field at y=O and y=b is zero and varies sinusoidally in the y dimension across rectangular waveguide 100.

Shown in FIG. 3*a* and FIG. 3*b* are graphical representations of the electric field magnitude across rectangular waveguide 100 for the $TE_{10}$ mode and the $TE_{01}$ mode. As can be seen from FIG. 3*a* and FIG. 3*b*, the magnitude of the transverse electric field follows the magnitude of a half cycle of a sinusoid across either the x axes or the y axes. The electric field rectangular waveguide 100 will go through a single maximum near the center and be substantially zero near the sidewalls of rectangular waveguide 100. It should be recognized that the previously discussed expressions for the transverse electric field apply to a rectangular waveguide for which there is only electromagnetic energy propagating in one direction. For an arrangement in which there might be a reflected wave in addition to a forward propagating wave, a standing wave will result. The distribution of the electric field for a cross section in the x-y plane would be the same. However, the maximum amplitude of the electric field will vary along the z axes and this would be taken into consideration to position media 20 for the drying operation.

Shown in FIG. 4 is a simplified schematic representation of an embodiment of the drying apparatus, including radiation heater 200. Radiation heater 200 generates electromagnetic energy that propagates through ink deposited on media 20. Most of the power dissipated in the ink results from exposure of the ink to the electric field. The heating of ink on media 20 results primarily from the action of the time varying electric field upon the dipoles within the ink. The orientation of the electric fields generated by radiation heater 200 relative to a longitudinal axes of fibers within media 20 contributes to the preferential dissipation of power emitted from radiation heater 200 in the ink deposited on the surface of media 20 instead of media 20. By using radiation heater 200, the increase in temperature experienced by media 20 during drying of the ink is lower than would result had convection or conduction heaters been used. As a result of the lower temperatures to which media 20 is exposed, shrinking of media 20 is reduced. Using resistive convection or conduction heaters to dry ink can cause shrinking of media 20 resulting from the power dissipated in the media. The shrinking can be sufficient to cause the print job to be discarded. Using the typical types of microwave heaters can also cause unacceptable amounts of warping in media 20 resulting from the absorption of microwave energy into media 20.

Because radiation heater 200 has the capability to supply sufficient power to rapidly dry ink on the surface of media 20 while keeping the power dissipated within media 20 at a relatively low level, the water included within the ink is less likely to be absorbed into the fibers of media 20 and shrinking resulting from heating of media 20 is less likely to result. Absorption of water into media 20 can cause a warping of media 20 known as cockle. The severity of cockle can be sufficient to cause discarding of the print job.

Radiation heater 200 includes rectangular waveguide 202 and a power source, such as electromagnetic energy source 204. Electromagnetic energy source 204 generates the electromagnetic radiation that propagates down rectangular waveguide 202. Electromagnetic energy source 204, could include for example, a magnetron tube to generate high frequency electromagnetic radiation. The radiation generated by electromagnetic energy source 204 is coupled into rectangular waveguide 202. The coupling of the electromagnetic radiation into rectangular waveguide 202 may be done so that either the $TE_{10}$ or the $TE_{01}$ mode of propagation results (with the frequency of the output from electromagnetic energy source 204 above the cutoff frequency of the desired mode) by proper placement of an output probe from electromagnetic energy source 204 within rectangular waveguide 202. With the output probe inserted into rectangular waveguide 202 so that it is parallel to the smallest cross sectional dimension of rectangular waveguide 202 and centered with respect to the largest cross sectional dimension, the $TE_{10}$ mode is excited. With the output probe inserted into rectangular waveguide 202 so that it is parallel to the largest cross sectional dimension of rectangular waveguide 202 and centered with respect to the smallest cross sectional dimension, the $TE_{01}$ mode is excited.

Typically media 20 is formed so that the longitudinal axes of the fibers within it are parallel to the longest dimension (perpendicular to the shortest dimension) of media 20. However, some sizes of media 20 are formed so that the longitudinal axes of the fibers are perpendicular to the longest dimension (parallel to the shortest dimension) of media 20. The orientation of the longitudinal axes of the fibers within media 20 with respect to its longest and shortest dimensions is generally determined by how large rolls of media 20 are cut after their formation. The fibers within media 20 contain water molecules. Upon exposure to a time varying electric field, the power dissipated within media 20 results primarily from the movement of polarized water molecules contained within the fibers of media 20. Furthermore, the amount of power absorbed by media 20 will be maximized when the electric field vector is substantially parallel to the orientation of the longitudinal axes of the fibers in media 20. As the orientation of the electric field vector changes from substantially parallel to the orientation of the longitudinal axes of the fibers in media 20 to substantially perpendicular to the longitudinal axes of the fibers in media 20, the amount of power absorbed into media 20 changes from a maximum to a minimum. However, the power absorbed by the ink placed upon media 20 does not have the orientation dependence that exists for media 20.

As can be seen from FIG. 4, media 20 moves through rectangular waveguide 202 through slot 206, with slot 206 placed on the face of rectangular waveguide 202 corresponding to the largest cross sectional dimension. Consider the case in which rectangular waveguide 202 is terminated by a load matched to its characteristic impedance so that there is a forward propagating wave down rectangular waveguide 202, but the amplitude of any reflected wave is substantially zero. In addition, the placement of the output probe from electromagnetic energy source 204 is such that the $TE_{10}$ mode is excited within rectangular waveguide 202. With the establishment of the $TE_{10}$ mode, the resulting electric field will exist substantially parallel to the direction of movement of media 20 through slot 206.

If a unit of media 20, with the longitudinal axes of its fibers orientated substantially parallel to its longest dimension, is moved through slot 206 in the direction of its long dimension, then the electric field will be substantially parallel to the longitudinal axes of the fibers. As a result, the power absorbed within media 20 will be at a relative maximum with respect to the absorption of power as a function of the spatial orientation between the electric field and the longitudinal axes of the fibers. However, if this unit of media 20 is moved through rectangular waveguide 202 so that the longitudinal axes of the fibers are substantially perpendicular to the electric field, then the power absorbed within media 20 will be at a relative minimum with respect to the absorption of power as a function of the spatial orientation between the electric field and the longitudinal axes of the fibers. Similarly, for a unit of media 20 having the longitudinal axes of the fibers substantially perpendicular to the longest dimension of the unit of media 20, the unit of media 20 can be moved through rectangular waveguide 202 so that the longitudinal axes of the fibers is substantially perpendicular to the electric field vector.

One way to reduce the power dissipated in a unit of media 20 is to control the orientation of the longitudinal axes of fibers within units of media 20 with respect to the direction of movement of media 20 through slot 206. However, consistently ensuring that the orientation of the longitudinal axes of the fibers on all units of media 20 passed through slot 206 is substantially perpendicular to the electric field may be difficult because of variation of the fiber orientation between units of media 20.

Another way in which to establish a substantially perpendicular relationship between the longitudinal axes of fibers within units of media 20 and the electric field is to orient the electric field so that it is perpendicular to a plane formed by a unit of media 20 moving through slot 206. For this orientation of the electric field, it will exist substantially perpendicular to the longitudinal axes of fibers within units of media 20 independent of the orientation of the longitudinal axes of the fibers within units of media 20 or the orientation of units of media 20 as they move through rectangular waveguide 202. Establishing the $TE_{01}$ mode within rectangular waveguide 202 will creates this relationship between the electric field and the longitudinal axes of the fibers. As a result for a $TE_{01}$ mode established within rectangular waveguide 202, the power absorbed by units of media 20 will be at a relative minimum.

For the $TE_{01}$ mode propagating in a rectangular waveguide, the wall currents on the largest area face flow in a direction parallel to the electric field (the vertical direction in FIG. 4). Placing Slot 206 in the axial direction on the largest area face of rectangular waveguide 202 would (without use of additional measures) disrupt the flow of the wall currents on the largest area face of rectangular waveguide 202 and interfere with the establishment of the $TE_{01}$ mode. Shown in FIG. 5 is a more detailed representation of rectangular waveguide 202. To reduce the effect of the disruption in the wall currents resulting from slot 206 and allow the $TE_{01}$ mode to propagate, an embodiment of a waveguide choke, waveguide choke 208 is attached at slot 206. In addition to allowing the $TE_{01}$ mode to propagate, the use of waveguide choke 208 substantially reduces the amount of energy that would otherwise be radiated from slot 206, providing for more efficient operation of embodiments of the drying apparatus. It should be recognized that although a specific implementation of a waveguide choke is shown in FIG. 5, other embodiments of a waveguide choke could be used to reduce the effect of the disruption in the wall currents. One implementation of a configuration similar to that shown in FIG. 5 uses a magnetron operating at 2.45 giga-hertz in a WR340 size rectangular waveguide.

In addition, although the slots are shown in FIG. 5 as located at the midpoint of their respective walls, the position of the slots could be moved toward either of the other walls in rectangular waveguide 202. Furthermore, it should be recognized that there are propagation modes (for example, the $TM_{11}$ mode in a rectangular waveguide) for which the wall currents flow in the axial direction of the rectangular waveguide. In a rectangular waveguide operating in the $TM_{11}$ mode, a slot can be placed in a wall in the axial direction to allow media to be moved through the slot so that the electric field exists substantially perpendicular to a plane defined by the media while moving through the rectangular waveguide. For a rectangular waveguide operating in the $TM_{11}$ mode, a waveguide choke would not need to be used because the disruption to the wall currents resulting from a slot in a wall in the axial direction is sufficiently small to permit propagation of the $TM_{11}$ mode.

The structure of waveguide choke 208 is matched to the wavelength of the $TE_{01}$ mode propagating within rectangular waveguide 202. Waveguide choke 208, shown in FIG. 5, is not necessarily in proper relative proportion to rectangular waveguide 202. Member 210 and member 212 (as well as the corresponding members on the opposite of rectangular waveguide 202 ) are each a quarter wavelength long. The short at the end of member 210 establishes a wall current maximum at this end of member 210. A quarter wavelength away from the short (at the intersection of member 210 and member 212) the wall currents are at zero. A quarter wavelength away from the intersection of member 210 and member 212 (at the intersection of member 212 with the face of rectangular waveguide 202) the wall currents are again at a maximum. Thus, the effect waveguide choke 208 is to reduce disruption of the wall currents at slot 206, thereby permitting the $TE_{01}$ mode to propagate within rectangular waveguide 202.

Achieving a substantially perpendicular spatial orientation between the electric field within rectangular waveguide 202 and the longitudinal axes of fibers within media 20 can be accomplished in ways other than that shown in FIG. 5. For example, shown in FIG. 6 is an implementation of rectangular waveguide 300 for which slot 302 has been placed on the smallest area face of rectangular waveguide 300. Waveguide choke 208 permits slot 302 to be placed in the axial direction on the smallest area face of rectangular waveguide 300 without substantial disruption of the wall currents. In this configuration, the $TE_{10}$ mode establishes a electric field substantially perpendicular to the fibers of media 20. Although FIG. 6 shows slot 302 located in the center of the face of rectangular waveguide 300, it should be recognized the slot 302 could be located near the top or bottom of the face. With slot 302 located near the top or bottom of the face, there may be less disruption of wall currents, thereby permitting the $TE_{10}$ mode to be more easily established as the dominant propagation mode.

It should be recognized that to establish a substantially perpendicular spatial relationship between the electric field and the longitudinal axes of the fibers of media 20, either the propagation mode or the face of the rectangular waveguide on which the slot is placed could be selected to establish the substantially perpendicular spatial relationship. Furthermore, it should be recognized that although FIG. 4 through FIG. 6 show media 20 arranged to pass through a single length of a rectangular waveguide, embodiments of the drying apparatus could be formed in which the rectangular waveguide includes multiple bends arranged to allow media 20 to pass through multiple segments of the rectangular waveguide. In addition, rectangular waveguide 202 and rectangular waveguide 300 could be modified to include an internal ridge on the top sidewall and an internal ridge on the bottom sidewall along the axial direction, centered at the midpoint along the cross section, respectively, of the top sidewall and the bottom sidewall. Where the ridges are located within the cross section of the rectangular waveguide, the distance between the top sidewall interior surface and the bottom sidewall interior surface is reduced. These ridges have an effect similar to the plates of a parallel plate capacitor to increase the uniformity and intensity of the electric field between the ridges within rectangular waveguide 202 and rectangular waveguide 300, thereby compensating for attenuation of the electric field magnitude resulting from power absorption by the ink and media.

Although the operation of embodiments of the drying apparatus that have been disclosed establish a substantially perpendicular spatial relation between the electric field and the longitudinal axes of fibers within the media, it should be recognized that preferential heating of ink instead of media could still be achieved without a substantially perpendicular spatial relationship. As the orientation between the electric field and the longitudinal axes of the fibers changes from substantially perpendicular to substantially parallel, the amount of power absorbed by the media will increase. If the amount of power absorbed by the media is not sufficient to cause noticeable shrinking of the media, then the power absorption increase resulting from non-perpendicularity between the electric field is not a problem.

Non-perpendicularity between the electric field and the longitudinal axes of the fibers can be controlled by changing the direction of media movement through the rectangular waveguide, the orientation of the media with respect to the direction of media movement through the rectangular waveguide, changing the orientation of the rectangular waveguide with respect to the direction of media movement through the rectangular waveguide, or some combination of two or more of these factors. In addition, non-perpendicularity between the electric field and the longitudinal axes of the fibers can be controlled as shown in FIG. 7 by locating slot 400 and slot 402 on opposite faces of rectangular waveguide 404 so that the plane in which media 20 moves through rectangular waveguide 404 is tilted with respect to the planes established by the two faces of the rectangular waveguide perpendicular to the electric field. In addition, slot 400 and slot 402 could be placed on the two faces of rectangular waveguide perpendicular to the electric field to achieve a different range of non-perpendicularity between the electric field and the longitudinal axes of the fibers. The degree of non-perpendicularity for which a problem will result from the absorption of power in the media will vary depending upon environmental conditions (such as temperature and humidity) and media types. Determination of the maximum permissible degree of non-perpendicularity so that the shrinkage of the media remains within an acceptable range can be done empirically for the expected range of media types and environmental conditions.

A first way in which the maximum acceptable degree of non-perpendicularity could be determined would use the configuration shown in FIG. 4, with slot 206 made sufficiently long to permit media 20 to move through slot 206 while rotated at any angle up to 90 degrees. With the $TE_{10}$ mode established within rectangular waveguide 202, the electric field will exist substantially parallel to the direction of movement of media 20 through slot 206. In addition, the long axes of media 20 will be substantially parallel to the direction of movement of media 20 through slot 206. To determine the relationship between the power absorbed within media 20 and the degree of non-perpendicularity, measurements of the media temperature change and forward power before and after the location of media 20 are made for a variety of angles between the long dimension of media 20 and the direction of movement of media 20 through slot 206. Measurement of the temperature of media 20 could be accomplished by using a thermal imaging camera[00ab] Then, by understanding the relationship between the amount of shrinking and the temperature media 20 reaches from the absorption of power, a maximum acceptable degree of non-perpendicularity can be determined. The maximum acceptable degree of non-perpendicularity is associated with a media temperature and a corresponding amount of shrinking and will vary depending upon the environmental conditions and the type of media for which the determination is made.

A second way in which the maximum acceptable degree of non-perpendicularity could be determined involves the measurement of the power propagated through rectangular waveguide 202 on the load side of media 20 while it is positioned within slot 206. A $TE_{10}$ mode is established within rectangular waveguide 202. The power propagated on the load side of media 20 is measured as the angle between the electric field and the longitudinal axes of the fibers within media 20 is changed. With the orientation between the electric field and the longitudinal axes of the fibers within media 20 incrementally changing from substantially parallel to substantially perpendicular, the incremental increase in power propagated down rectangular waveguide 202 toward load 200 results from a reduction in the power absorbed by media 20. Furthermore, by measuring the propagated power without media 20 located within slot 206 and determining the difference between this value and the measured value of the power propagated with media 20 located within slot 206 while the longitudinal axes of the fibers are located substantially perpendicular to the electric field, the minimum amount of power absorbed by media 20 can be measured. Using the empirically determined relationship between the power absorbed by media 20 as a function of orientation and by knowing media shrinkage as a function of absorbed power, the maximum allowable non-perpendicularity between the electric field and the fibers can be determined. A third way in which the maximum acceptable degree of non-perpendicularity could be determined would combine the first and second methods[00ab]

Although embodiments of the drying apparatus have been disclosed in the context of a rectangular waveguide, it should be recognized that other waveguide structures may be used to establish a substantially perpendicular spatial relationship between fibers in media 20 and an electric field. For example, it may be possible to use a circular waveguide with a waveguide choke.

Shown in FIG. 8 is an example of a circular waveguide 500 that could be used for an embodiment of the drying apparatus. Circular waveguide 500 is operating in the $TE_{11}$ mode. In the $TE_{11}$ mode, the axial electric field is zero and the transverse electric has field lines as shown in FIG. 8. At the cross section through which media 20 moves, the electric field lines are substantially perpendicular to the plane defined by media 20. It should be recognized that slot 502 and slot 504 could be move around the circumference of circular waveguide without establishing a degree of non-perpendicularity between the longitudinal axes of the fibers in media 20 and the electric field.

Although embodiments of the drying apparatus have been illustrated, and described, it is readily apparent to those of ordinary skill in the art that various modifications may be made to these embodiments without departing from the scope of the appended claims.

What is claimed is:

1. A drying apparatus for drying a fluid residing on media, comprising:

a waveguide having an aperture configured to allow the media to move through the aperture; and an electromagnetic energy source configured to establish an electric field within the waveguide, with an angle formed between a direction of the electric field and longitudinal axes of fibers within the media greater than ten degrees and less than or equal to ninety degrees.

2. The drying apparatus as recited in claim 1, wherein:

the electromagnetic energy source and the aperture include a configuration to establish the electric field and the longitudinal axes of the fibers in different planes.

3. The drying apparatus as recited in claim 2, wherein:

the waveguide includes a rectangular cross section formed from a first sidewall, a second sidewall, a third sidewall, and a fourth sidewall, with the first sidewall located opposite the second sidewall and the third sidewall located opposite the fourth sidewall; and the aperture includes a first slot located in the first sidewall and a second slot located in the second sidewall.

4. The drying apparatus as recited in claim 3, wherein:

a first location of the first slot and a second location of the second slot in, respectively, the first sidewall and the second sidewall, define a first plane, with an angle between the first plane and a second plane defined by the third sidewall greater than ten degrees and less than ninety degrees.

5. The drying apparatus as recited in claim 4, wherein:

the first sidewall and the second sidewall correspond to sides of the rectangular cross section with a largest dimension;

the electric field includes a transverse electric field; and the electromagnetic energy source includes a configuration to establish the transverse electric field substantially parallel to the first sidewall and the second sidewall.

6. The drying apparatus as recited in claim 5, wherein:

the transverse electric field corresponds to a $TE_{01}$ mode;

the electromagnetic energy source includes a magnetron tube configured to generate electromagnetic energy at a frequency greater than a giga-hertz; and the rectangular waveguide includes waveguide chokes coupled to the first sidewall and the second sidewall adjacent to the first slot and the second slot.

7. The drying apparatus as recited in claim 1, wherein:

the angle ranges from greater than or equal to forty-five degrees to less than or equal to ninety degrees.

8. The drying apparatus as recited in claim 7, wherein:

the electromagnetic energy source and the aperture include a configuration to establish the electric field and the longitudinal axes of the fibers in different planes.

9. The drying apparatus as recited in claim 8, wherein:

the waveguide includes a rectangular cross section formed from a first sidewall, a second sidewall, a third sidewall, and a fourth sidewall with the first sidewall located opposite the second sidewall and the third sidewall located opposite the fourth sidewall; and the aperture includes a first slot located in the first sidewall and a second slot located in the second sidewall.

10. The drying apparatus as recited in claim 9, wherein:

a first location of the first slot and a second location of the second slot in, respectively, the first sidewall and the second sidewall, define a first plane with an angle between the first plane and a second plane defined by the third sidewall greater than forty-five degrees and less than ninety degrees.

11. The drying apparatus as recited in claim 9, wherein:

the first sidewall and the second sidewall correspond to sides of the rectangular cross section with a smallest dimension;

the electric field includes a transverse electric field; and the electromagnetic energy source includes a configuration to establish the transverse electric field substantially parallel to the first sidewall and the second sidewall.

12. The drying apparatus as recited in claim 11, wherein:

the transverse electric field corresponds to a $TE_{10}$ mode;

the electromagnetic energy source includes a magnetron tube configured to generate electromagnetic energy at a frequency greater than a giga-hertz; and the rectangular waveguide includes waveguide chokes coupled to the first sidewall and the second sidewall adjacent to the first slot and the second slot.

13. The drying apparatus as recited in claim 1, wherein:

the waveguide includes a circular cross section having a center and a circular sidewall;

the aperture includes a first slot located in the circular sidewall and a second slot located in the circular sidewall opposite the first slot through the center;

the electric field includes a transverse electric field; and the electromagnetic energy source includes a configuration to establish the transverse electric field substantially perpendicular to a plane formed by the first slot and the second slot at the plane.

14. The drying apparatus as recited in claim 13, wherein:

the transverse electric field corresponds to a $TE_{11}$ mode;

the electromagnetic energy source includes a magnetron tube configured to generate electromagnetic energy at a frequency greater than a giga-hertz; and the circular waveguide includes waveguide chokes coupled to the circular sidewall adjacent to the first slot and the second slot.

15. A method for drying a fluid residing on media, comprising:

generating an electric field; and exposing the media and the fluid to the electric field, with an angle between the electric field and a longitudinal axes of fibers included within the media greater than ten degrees and less than or equal to ninety degrees.

16. The method as recited in claim 15, further comprising:

moving the media and the fluid into a waveguide through an aperture before exposing the media and the fluid to the electric field.

17. The method as recited in claim 16, wherein:

generating the electric field includes orientating the electric field so that the electric field and the longitudinal axes of the fibers exist in different planes.

18. The method as recited in claim 17, wherein:

exposing the media and the fluid to the electric field includes exposing the media and the fluid to the electric field for a predetermined time selected to substantially dry the fluid.

19. The method as recited in claim 18, wherein:

the angle ranges from greater than or equal to 45 degrees to less than or equal to 90 degrees.

20. The method as recited in claim 19, wherein:

generating the electric field includes generating the electric field in the $TE_{01}$ mode, with the waveguide including a rectangular waveguide.

21. The method as recited in claim 19, wherein:

generating the electric field includes generating the electric field in the $TE_{10}$ mode, with the waveguide including a rectangular waveguide.

22. The method as recited in claim 19, further comprising:

generating the electric field includes generating the electric field in the $TE_{11}$ mode, with the waveguide including a circular waveguide.

23. An imaging device for forming an image on media corresponding to image data, comprising:

a controller configured to generate signals from the image data;

a print head arranged to receive the signals and configured to eject ink onto the media according to the signals; and a drying apparatus including a waveguide having an aperture configured to allow the media to move through the aperture and an electromagnetic energy source configured to establish an electric field within the waveguide, with an angle formed between a direction of the electric field and longitudinal axes of fibers within the media greater than forty-five degrees and less than or equal to ninety degrees.

24. The imaging device as recited in claim 23, wherein:

the electromagnetic energy source and the aperture include a configuration to establish the electric field and the longitudinal axes of the fibers in different planes.

25. The imaging device as recited in claim 24, wherein:

the controller includes a configuration to generate print data from the image data and includes a print head driver configured to generate the signals from the print data;

the waveguide includes a rectangular cross section formed from a first sidewall, a second sidewall, a third sidewall, and a fourth sidewall with the first sidewall located opposite the second sidewall and the third sidewall located opposite the fourth sidewall; and the aperture includes a first slot located in the first sidewall and a second slot located in the second sidewall.

26. The imaging device as recited in claim 25, wherein:

a first location of the first slot and a second location of the second slot in, respectively, the first sidewall and the second sidewall, define a first plane, with an angle between the first plane and a second plane defined by the third sidewall greater than forty-five degrees and less than ninety degrees.

27. The imaging device as recited in claim 26, wherein:

the first sidewall and the second sidewall correspond to sides of the rectangular cross section with a largest dimension;

the electric field includes a transverse electric field; and the electromagnetic energy source includes a configuration to establish the transverse electric field substantially parallel to the first sidewall and the second sidewall.

28. The imaging device as recited in claim 27, wherein:

the transverse electric field corresponds to a $TE_{01}$ mode;

the electromagnetic energy source includes a magnetron tube configured to generate electromagnetic energy at a frequency greater than a giga-hertz; and the rectangular waveguide includes waveguide chokes coupled to the first sidewall and the second sidewall adjacent to the first slot and the second slot.

29. The imaging device as recited in claim 27, wherein:

the transverse electric field corresponds to a $TE_{10}$ mode;

the electromagnetic energy source includes a magnetron tube configured to generate electromagnetic energy at a frequency greater than a giga-hertz; and the rectangular waveguide includes waveguide chokes coupled to the first sidewall and the second sidewall adjacent to the first slot and the second slot.

30. The imaging device as recited in claim 27, wherein:

the transverse electric field corresponds to a $TE_{11}$ mode;

the electromagnetic energy source includes a magnetron tube configured to generate electromagnetic energy at a frequency greater than a giga-hertz; and the circular waveguide includes waveguide chokes coupled to the circular sidewall adjacent to the first slot and the second slot.

* * * * *